US008078087B2

(12) United States Patent
Yoshimoto et al.

(10) Patent No.: US 8,078,087 B2
(45) Date of Patent: Dec. 13, 2011

(54) TONER CARRYING DEVICE AND IMAGE FORMING APPARATUS

(75) Inventors: Yuhsuke Yoshimoto, Yamatotakada (JP); Masanobu Deguchi, Kashiba (JP); Takeshi Wakabayashi, Kizugawa (JP); Kohichi Takenouchi, Tenri (JP); Kiyofumi Morimoto, Tenri (JP); Hiroo Naoi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 455 days.

(21) Appl. No.: 12/266,971

(22) Filed: Nov. 7, 2008

(65) Prior Publication Data

US 2009/0129824 A1 May 21, 2009

(30) Foreign Application Priority Data

Nov. 19, 2007 (JP) ..... 2007-299697

(51) Int. Cl.
*G03G 15/08* (2006.01)

(52) U.S. Cl. ..... 399/258; 399/120; 399/260; 399/262

(58) Field of Classification Search ..... 399/258, 399/260, 120, 262

See application file for complete search history.

(56) References Cited

U.S. PATENT DOCUMENTS

| | | | | |
|---|---|---|---|---|
| 7,668,489 | B2 * | 2/2010 | Kim et al. | 399/258 |
| 2006/0062601 | A1 * | 3/2006 | Jeong | 399/238 |
| 2006/0078355 | A1 * | 4/2006 | Yahagi | 399/258 |
| 2007/0237551 | A1 * | 10/2007 | Kawai | 399/258 |

FOREIGN PATENT DOCUMENTS

| | | | |
|---|---|---|---|
| JP | 09-230684 | | 9/1997 |
| JP | 11-143202 | | 5/1999 |
| JP | 2009258480 | A * | 11/2009 |
| JP | 2010054755 | A * | 3/2010 |

* cited by examiner

*Primary Examiner* — David Gray
*Assistant Examiner* — G. M. Hyder
(74) *Attorney, Agent, or Firm* — Nixon & Vanderhye P.C.

(57) ABSTRACT

A toner carrying device includes a flexible sheet, and a sheet moving mechanism for allowing the flexible sheet to move back and forth by pulling the flexible sheet. In the flexible sheet, a toner passage hole for leaving a first opening section of a toner carrying pipe to open is provided. In a case where the toner passage hole is divided into first through three areas in such a manner that (i) the first area is provided on a side of one end of the flexible sheet in a direction orthogonal to a moving direction of the flexible sheet; (ii) the second area is provided on a side of the other end of the flexible sheet in the direction orthogonal to the moving direction; and (iii) the third area is provided between the first area and the second area, the third area extends broader in the moving direction than respective of the first and second areas. This allows the flexible sheet partially having the toner passage hole in its area to move smoothly.

19 Claims, 10 Drawing Sheets

TONER CARRYING DEVICE AND IMAGE FORMING APPARATUS

This Nonprovisional application claims priority under 35 U.S.C. §119(a) on Patent Application No. 299697/2007 filed in Japan on Nov. 19, 2007, the entire contents of which are hereby incorporated by reference.

FIELD OF THE TECHNOLOGY

The present technology is related to a toner carrying device for carrying toner to a certain position.

BACKGROUND OF THE TECHNOLOGY

An electrophotographic image forming apparatus has been widely used, for example, in a copying machine, printer, facsimile device, and multifunctional apparatus, because it is capable of forming a high quality image in an easy operation within a short time, and because its maintenance management is also easy. An electrophotographic image forming apparatus (hereinafter simply referred to as "image forming apparatus") includes, for example, a photoreceptor, a charging device, an exposure device, a developing device, a transfer device, and a fixing device.

The photoreceptor is a roller member having a surface formed with a photosensitive film. The charging device is for charging the surface of the photoreceptor to a certain electric potential in response to an applied voltage. The exposure device irradiates the charged surface with the light which varies depending on image information so as to form an electrostatic latent image on the charged surface. The developing device provides toner to an electrostatic latent image on the surface of the photoreceptor so as to develop a toner image. The transfer device transfers the toner image on the surface of the photoreceptor to a recording medium (paper).

The fixing device includes, for example, a fixing roller having heating means inside and a pressure roller provided to press against the fixing roller. A recording medium having an unfixed toner image goes through a pressure part between the fixing roller and the pressure roller. This causes the toner image to be fixed to the recoding medium by heat. As a result, an image is printed on the recoding medium.

The developing device includes (i) a developing roller provided to face a rotating photoreceptor on which an electrostatic latent image is formed and (ii) a developer tank which contains developer. The developing roller carries developer inside the developer tank toward the photoreceptor so that an electrostatic latent image on the photoreceptor is developed. In a case where a developer is two-component developer composed of toner and carrier, carrier is left in the developer tank whereas toner is consumed and used for a development of the toner image. A toner supply device supplies another toner to the developing chamber so as to replenish the used amount.

In the developing device with use of two-component developer, it is necessary to mix carrier and toner with a stirring member. The stirring member stirs developer in the developer tank for a certain period of time for charging it to a certain electric potential before carrying out an actual development operation. This is called a preliminary stirring. When the developing device starts carrying out a development operation, the stirring member stirs developer in the developer tank and mixes toner replenished from a toner cartridge and the developer in the developer tank. The developer thus mixed is supplied to the photoreceptor and is used for a development of electrostatic latent image.

Toner is replenished to the developer tank in such a manner that a proper amount of toner is replenished from the toner cartridge to the developer tank at a predetermined timing while a toner supplying port of a toner cartridge and a toner replenishing port of the developing chamber are communicated with each other. In each of the toner supplying port and the toner replenishing port, a shutter is provided. Each of the shutters opens the toner replenishing port and the toner replenishing port when toner is replenished and when a toner cartridge or a developing device is mounted in an image forming apparatus. Whereas, each of the shutters closes the toner supplying port and the toner replenishing port when the developing device is detached from the image forming apparatus so that toner does not leak from either the toner supplying port or the toner replenishing port.

For example, an image forming apparatus in the following patent document 1, a shutter is provided for opening or closing an opening section which is located one end of a toner carrying passage (toner carrying pipe) which causes a toner hopper and a developing device to be communicated with each other. This shutter opens when a developing unit is mounted, and closes when the developing unit is detached.

[Patent Document 1] Japanese Unexamined Patent Publication, Tokukai, 2007-78848 (date of publication: Mar. 29, 2007)

[Patent Document 2] Japanese Unexamined Patent Publication, Tokukaihei, 9-230684 (date of publication: Sep. 5, 1997)

However, in a case of opening or closing the toner carrying passage by using a shutter disclosed in the patent document 1, it is necessary to secure a shelter of the shutter (storage space) while the opening section opens. This causes a problem that space saving of an image forming apparatus is prevented.

On the other hand, in the patent document 2, it is disclosed that a shutter realized by a flexible sheet is provided in a developer replenishing device. The flexible sheet is illustrated in FIG. 11 (*a*) and FIG. 11 (*b*). As illustrated in FIGS. 11 (*a*) and 11 (*b*), a toner passage hole 110 is provided in part of a flexible sheet 120. FIG. 11 (*b*) is a cross-section view of the flexible sheet in FIG. 11 (*b*), viewed along arrows AA.

According to the developer replenishing device, the flexible sheet 120 is moved back and forth (slides) in a direction X so that (i) an opening section for replenishing toner and the toner passage hole 110 overlap each other while toner is replenished and (ii) an area 100 in which the toner passage hole 110 is not formed in the flexible sheet 120 and the opening section for replenishing toner overlap each other while toner is not replenished. This allows toner to be replenished via the opening section which is opened while toner is replenished, and also allows toner not to be replenished because the opening section is closed while toner is not replenished. The flexible sheet 120 becomes compact with ease because of its flexibility. Therefore, it is also possible to save a space for storing the flexible sheet 120, thereby leading in saving space for an image forming apparatus.

As illustrated in FIG. 11 (*a*), the toner passage hole 110 in the flexible sheet 120 has a rectangular shape defined by opposite sides 110*a*, which extend in a direction orthogonal to the moving direction X, and opposite sides 110*b*, which extend in parallel to the moving direction X.

The flexible sheet 120 does not posses an adequate stiffness in thickness direction. Therefore, in a case where the toner passage hole 110 is prepared to have a shape as illustrated in FIG. 11, a peripheral edge of the opposite sides 110*a* bend in a perpendicular direction with respect to a surface of the flexible sheet as illustrated in FIGS. 12 (*a*) and (*b*), in response to pull strength, applied to the flexible sheet 120, causing the flexible sheet 120 to slide in the moving direction X. Note that FIG. 12 (*b*) is a cross-section view of the flexible sheet 120 in FIG. 12 (*a*), viewed along arrows BB.

If the flexible sheet 120 slides in a condition illustrated in FIG. 12, the bent part in the flexible sheet 120 gets stuck with an edge of the opening section. As a result, the flexible sheet 120 may fail to slide smoothly.

SUMMARY OF THE TECHNOLOGY

An object of the technology is to smoothly move a flexible sheet in a toner carrying device which allows the flexible sheet partially having a toner passage hole in its area to move.

A toner carrying device includes a toner carrying pipe which includes a first opening section via which toner passes; a flexible sheet which includes a toner passage hole in part of its area and moves back and forth in a certain pathway; and a sheet moving mechanism for switching, by pulling the flexible sheet so that the flexible sheet is moved back and forth, between (i) a first state in which an area of the flexible sheet where the toner passage hole is not provided and the first opening section overlap each other so that the first opening section is closed and (ii) a second state in which the toner passage hole and the first opening section overlap each other so that the first opening section is opened, the toner passage hole being provided (i) so as to be divided into first through third areas so that the first through third areas are arranged in a line in a direction orthogonal to a moving direction in which the flexible sheet is moved back and forth, and (ii) so that the third area extends broader in the moving direction than respective of the first and second areas, where the first area is provided on a side of one end of the flexible sheet in the direction orthogonal to the moving direction, the second area is provided on a side of the other end of the flexible sheet in the direction orthogonal to the moving direction, and the third area is provided between the first area and the second area.

In a case where the third area extends broader in the moving direction rather than respective of the first and second areas, it is possible to prevent bending from occurring around the periphery of the toner passage hole even though a pull strength is applied to the flexible sheet so as to move it back and forth in the moving direction. Therefore, it is possible to suppress the occurrence of a situation in which the periphery of the toner passage hole gets stuck with the periphery of the first opening section, thereby resulting in smooth movement of the flexible sheet.

Additional objects, features, and strengths of the technology will be made clear by the description below. Further, the advantages of the technology will be evident from the following explanation in reference to the drawings.

BRIEF DESCRIPTION OF THE DRAWINGS

FIG. 3 (*b*) is an explanatory drawing illustrating a positional relationship between the opening section of the toner carrying pipe and the flexible sheet while the opening section of the toner carrying pipe is opened.

FIG. 10 (*b*) is an explanatory drawing illustrating a first modified toner passage hole. FIG. 10 (*c*) is an explanatory drawing illustrating a second modified toner passage hole.

FIG. 11 (*b*) is a cross-section view of the flexible sheet illustrated in FIG. 11 (*a*), viewed along arrows AA.

FIG. 12 (*b*) is a cross-section view illustrating the flexible sheet illustrated in FIG. 12 (*a*), viewed along arrows AA.

DESCRIPTION OF THE EMBODIMENTS

The following description deals in detail with a toner carrying device (toner carrying unit) in accordance with an embodiment of the present technology with reference to FIG. 1 through FIG. 5, and FIG. 10.

Figure 1:
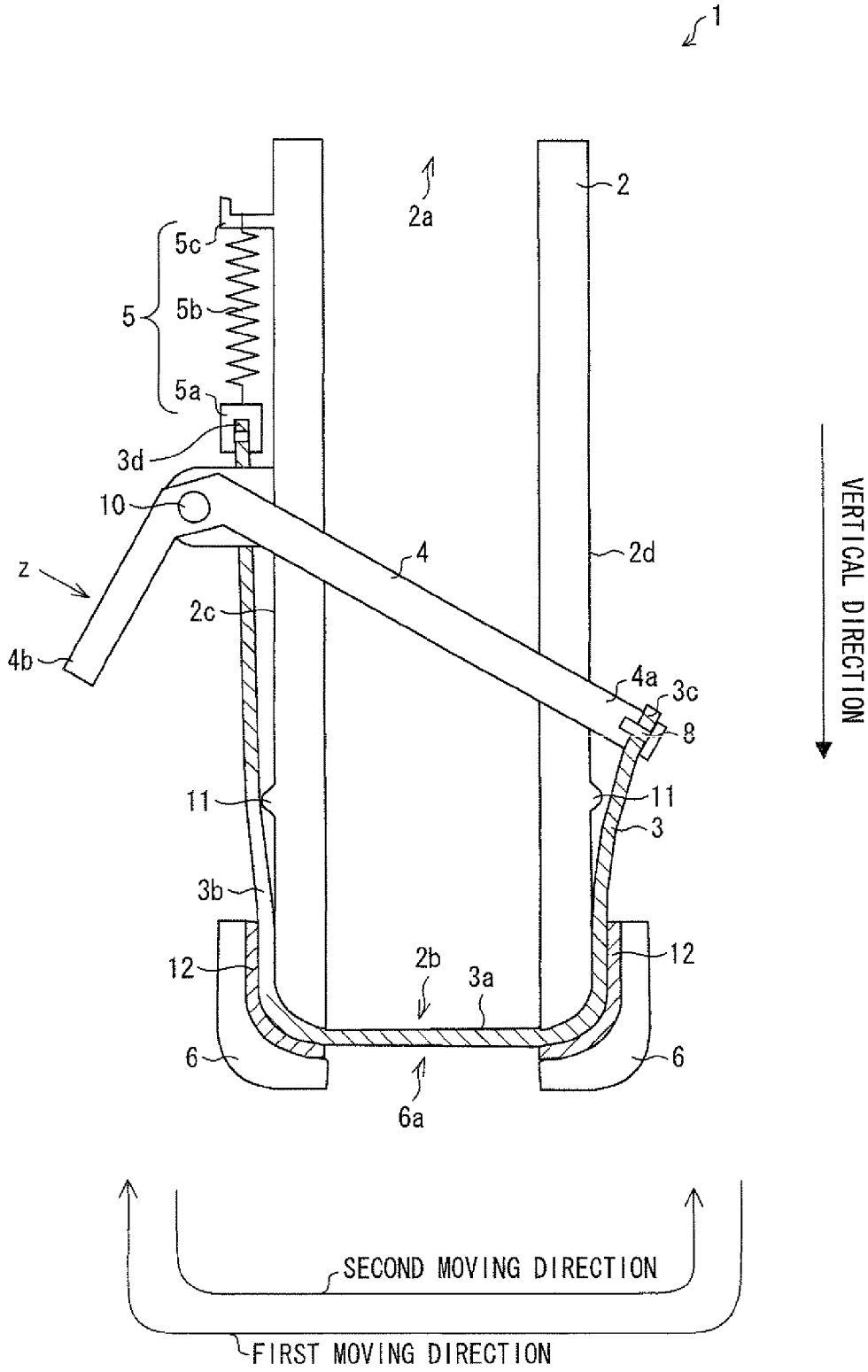
FIG. 1 is a schematic view of an inner part of a toner carrying device in accordance with an embodiment of the present technology illustrating that an opening section of a toner carrying pipe is closed by a flexible sheet.
Figure 2:
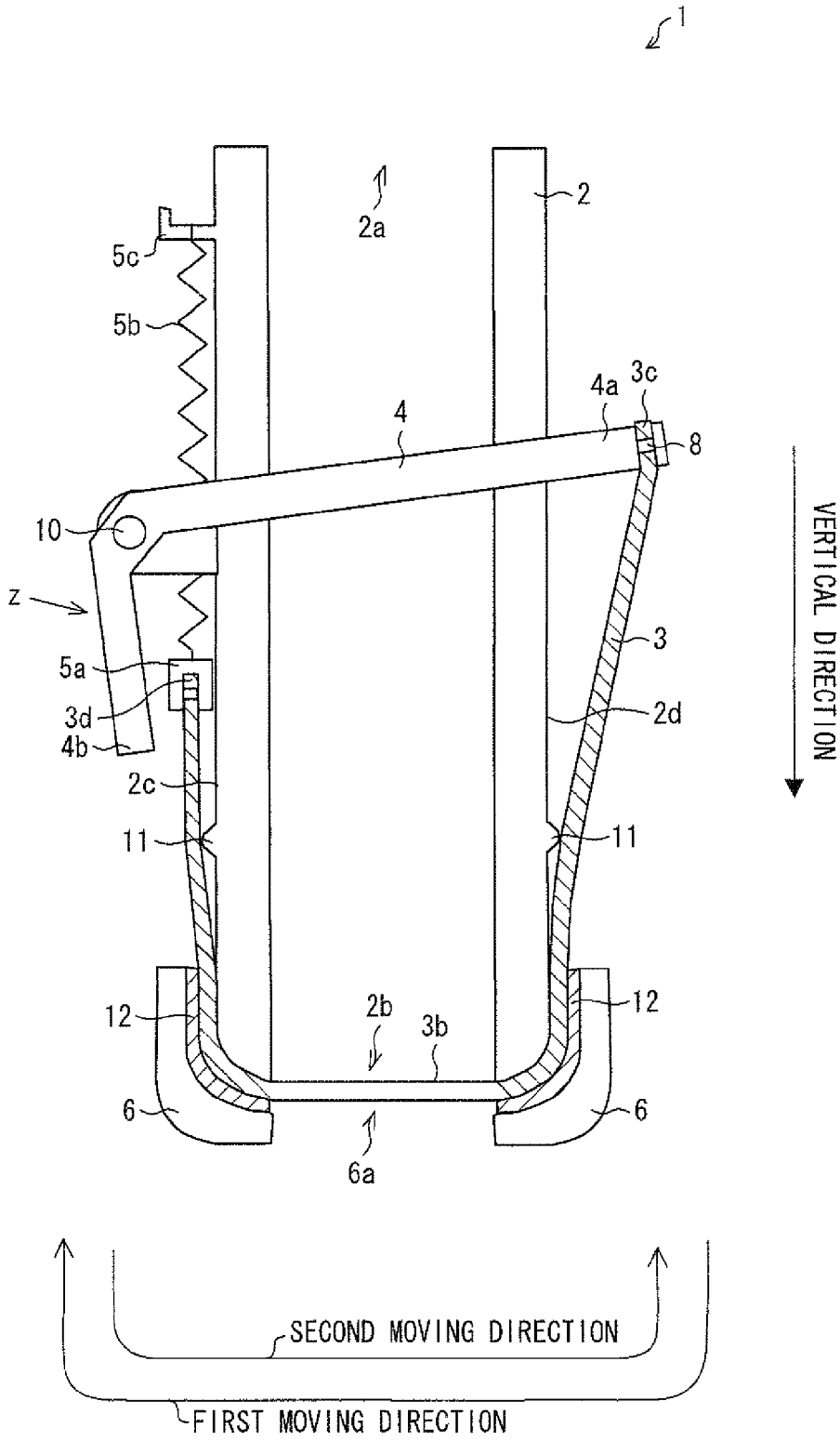
FIG. 2 is a schematic view of an inner part of the toner carrying device of the present technology illustrating that the opening section of the toner carrying pipe is opened.
Figure 3:
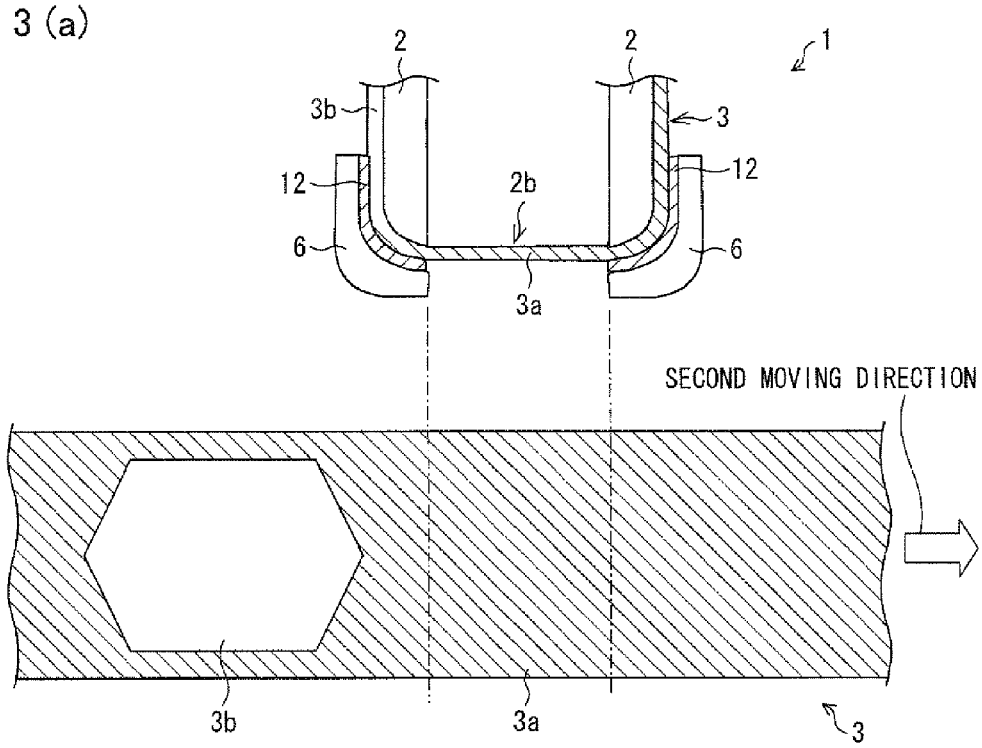
FIG. 3 (*a*) is an explanatory drawing illustrating a positional relationship between the opening section of the toner carrying pipe and the flexible sheet while the opening section of the toner carrying pipe is closed.
Figure 3:
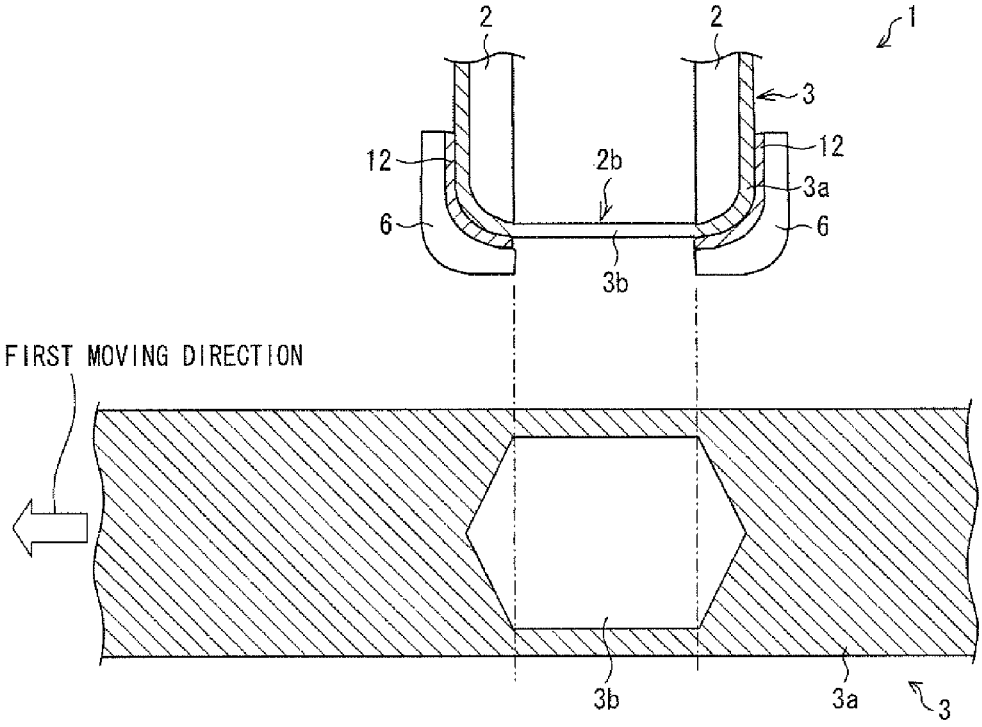
Figure 4:
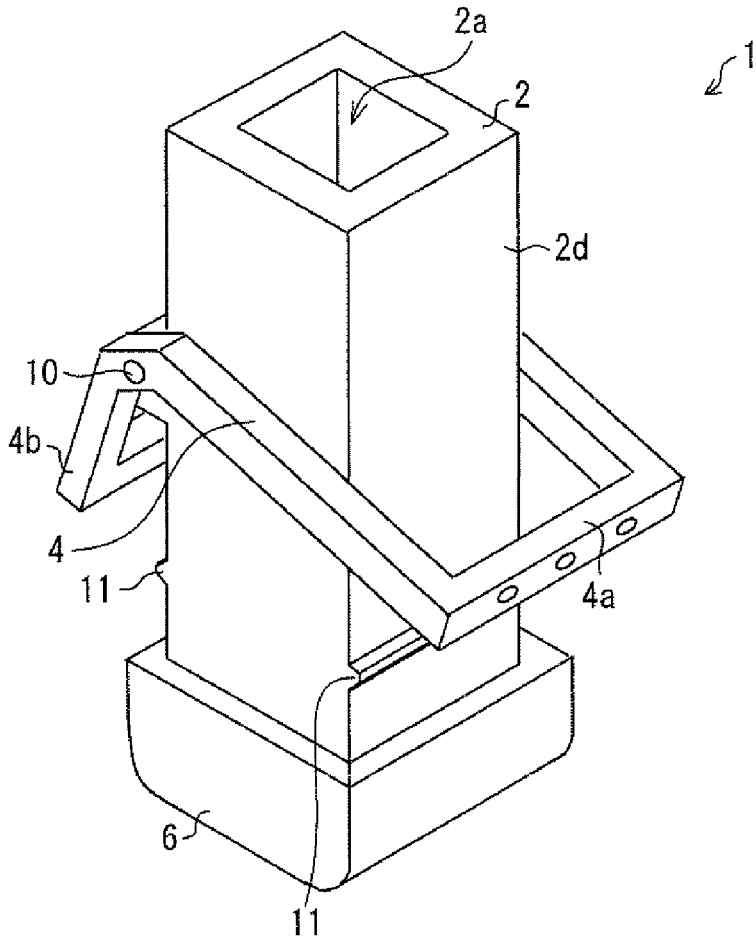
FIG. 4 is a perspective view illustrating an overview of the toner carrying device illustrated in FIG. 1 and FIG. 2.
Figure 5:
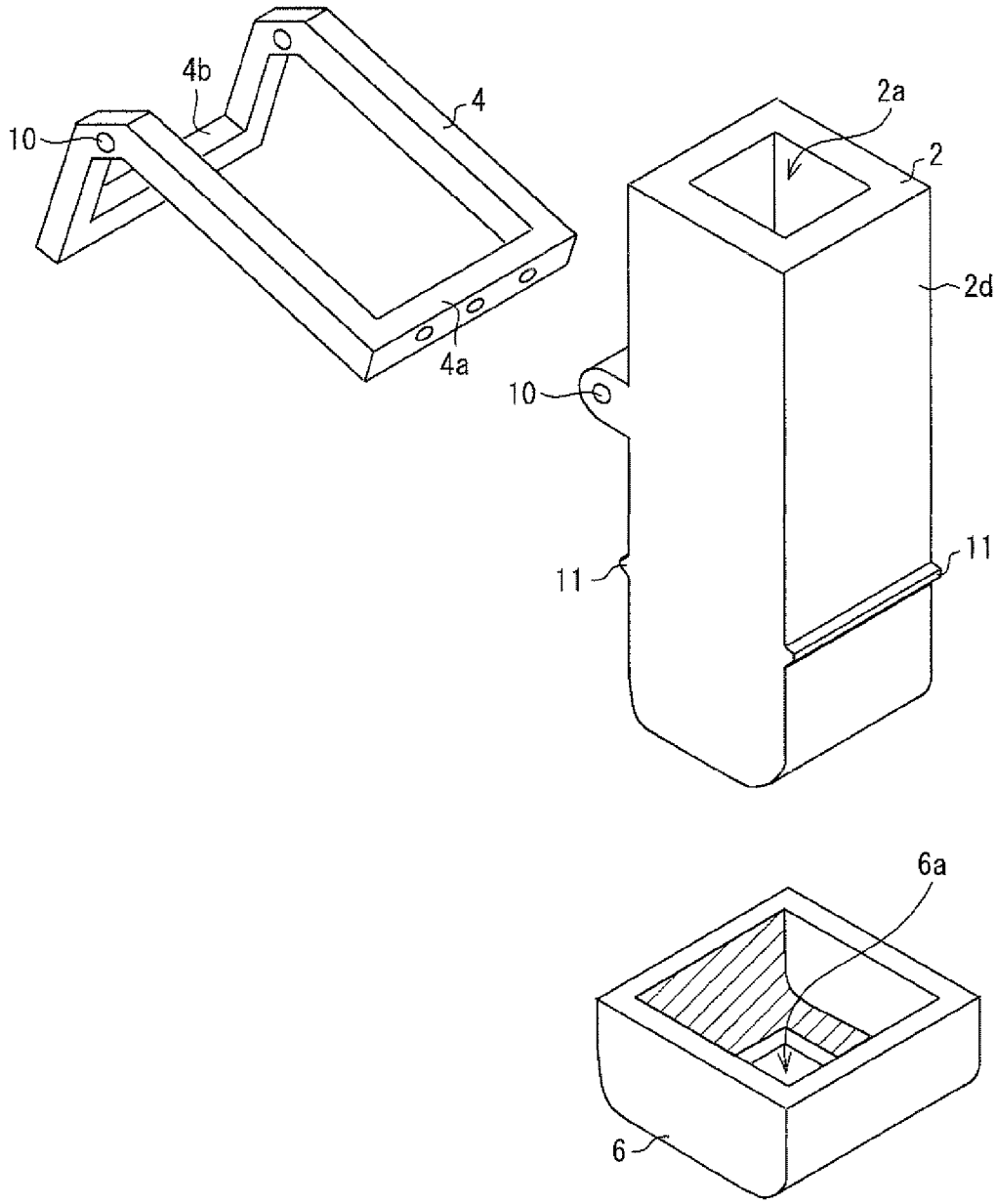
FIG. 5 is an exploded view illustrating the toner carrying device illustrated in FIG. 4.

FIG. 1 and FIG. 2 are schematic views illustrating an inner part of a toner carrying device 1 of the present embodiment. FIG. 3 (*a*) and FIG. 3 (*b*) are explanatory drawings illustrating a positional relationship between an opening section 2*b* of the toner carrying device 1 and a flexible sheet 3. FIG. 4 is a perspective view illustrating an overview of the toner carrying device 1. FIG. 5 is a drawing illustrating the toner carrying device 1 which is disassembled.

As illustrated in FIG. 1, FIG. 4, and FIG. 5, the toner carrying device 1 includes a quadrangular prism toner carrying pipe 2, a flexible sheet 3, a lever 4, a traction section 5, and a pressure guide member 6. In FIG. 4 and FIG. 5, the flexible sheet 3 is omitted to clearly show an overview of the toner carrying pipe 2.

The toner carrying pipe 2 functions as a pipe for causing an opening section 2*a* (second opening section) provided in one end and a opening section 2*b* (first opening section) provided in the other end to communicate with each other, and functions as a toner carrying passage whose vertical direction is a direction directing from the opening section 2*a* to the opening section 2*b*. Namely, toner supplied from the opening section 2*a* is discharged from the opening section 2*b* due to free-fall.

The toner carrying pipe 2 is a quadrangular prism which has four outer wall surfaces. As illustrated in FIG. 1, it is assumed that an outer wall surface on which the traction section 5 is provided is an outer wall surface 2*c* and an outer wall surface which is parallel to the outer wall surface 2*c* is an outer wall surface 2*d*.

As illustrated in FIG. 3 (*a*) and FIG. 3 (*b*), the flexible sheet 3 is a long sheet which includes a sealing area 3*a* with which the opening section 2*b* is blocked, and a toner passage hole 3*b* via which toner inside the toner carrying pipe 2 is discharged to the outside from the opening section 2*b* by leaving the opening section 2*b* open. As illustrated in FIG. 1 and FIG. 2, the flexible sheet 3 is provided so that one end part 3*c* of the flexible sheet 3 faces the outer wall 2*d*; the other end part 3*d* of the flexible sheet 3 faces the outer wall 2*c*; and a central part of the flexible sheet faces the opening section 2*b* of the toner carrying pipe 2.

The flexible sheet 3 is not limited to a specific material, provided that it is a sheet made of a flexible material. In this embodiment, a sheet made of fluorine resin (e.g. Tefron (registered trade name)) is used as the flexible sheet 3.

As illustrated in FIG. 4 and FIG. 5, the lever (sheet moving mechanism) 4 is an L-shaped lever, which is attached to the toner carrying device 1 so that the lever 4 can rotate around a supporting axis 10. As illustrated in FIG. 1 and FIG. 2, the lever 4 is fitted in the toner carrying pipe 2 so that one end part 4*a* of the lever 4 is arranged on the outer wall surface 2*d* side, and the other end part 4*b* of the lever 4 is arranged on the outer wall surface 2*c* side.

Further, the end part 3*c* of the flexible sheet 3 is fixed to the end part 4*a* of the lever 4 via a fixing member 8. As illustrated in FIG. 1 and FIG. 2, when an external force is applied to the lever 4 so as to make the end part 4*b* of the lever 4 closer to the outer wall surface 2*c* (an external force is applied in a direction Z shown in FIG. 1), the end part 4*a* of the lever 4 is pulled up, on the outer wall surface 2*d* side, in a direction reverse to the vertical direction. This causes (i) the flexible sheet 3 to move, on the outer wall surface 2*d* side, in the direction reverse to the vertical direction; (ii) the flexible sheet 3 to move, on the opening section 2*b* side, in a direction directing from the outer wall surface 2*c* to the outer wall surface 2*d*; and (iii) the flexible sheet 3 to move, on the outer wall surface 2*c* side, in the vertical direction.

As illustrated in FIG. 1, the traction section (sheet moving mechanism) 5 includes a fixing member 5*a*, a spring member (sheet moving mechanism, elastic member) 5*b*, and a hook 5*c*. In the traction section 5, the hook 5*c* hangs one end part of the spring member 5*b* and the other end part of the spring member 5*b* is fixed to the end part 3*d* of the flexible sheet 3 via the fixing member 5*a*. The spring member 5*b* produces a force of restitution in a direction reverse to the vertical direction so as to pull the flexible sheet 3. As such, as illustrated in FIG. 1 and FIG. 2, when the external force applied to the lever 4 in the direction Z is weakened, (i) the flexible sheet 3 is pulled (moved) in the direction reverse to the vertical direction on the outer wall surface 2*c* side; (ii) the flexible sheet 3 is moved, on the opening section 2*b* side, in a direction directing from the outer wall surface 2*d* to the outer wall surface 2*c*; and (iii) the flexible sheet 3 is moved, on the outer wall surface 2*d* side, in the vertical direction. FIG. 1 illustrates a situation in which the spring member 5*b* contracts. FIG. 2 illustrates a situation in which the spring member 5*b* extends.

The pressure guide member 6 is fitted in the toner carrying pipe 2 at the end parts of the toner carrying pipe 2 so as to face the toner carrying pipe 2 via the flexible sheet 3. As illustrated in FIG. 1 and FIG. 5, the pressure guide member 6 has an opening section 6*a* which has substantially the same area as the opening section 2*b*. The pressure guide member 6 is fitted in the toner carrying pipe 2 so that the opening section 2*b* and the opening section 6*a* overlap each other via the flexible sheet 3. This allows the flexible sheet 3 to be slidable between the pressure guide member 6 and the toner carrying pipe 2 around the periphery of the opening section 2*b*.

As illustrated in FIG. 1, the toner carrying pipe has curved surfaces (a curved shape) between the opening section 2*b* and respective of the outer wall surfaces 2*c* and 2*d* so that the flexible sheet 3 can move smoothly.

Further, as illustrated in FIG. 1, a moltopren 12 is provided between the pressure guide member 6 and the toner carrying pipe 2. The moltopren 12 (polyurethane, cushioning material) between the pressure guide member 6 and the toner carrying pipe 2 is intended to reduce friction while the flexible sheet 3 moves. In the structure shown in FIG. 1, the moltopren 12 is attached to the inner surface of the pressure guide member 6 (a surface that faces the toner carrying pipe 2) via a double-face adhesive tape. It can be attached around the periphery of the opening section 2*b*, instead of being attached to the inner part of the pressure guide member 6.

According to the toner carrying device 1 as above explained, in a state where the spring member 5*b* contracts (see FIG. 1 and FIG. 3 (*a*)), (i) the toner passage hole 3*b* of the flexible sheet 3 is located on the outer wall surface 2*c* and (ii) the sealing area 3*a* of the flexible sheet 3 is located on the opening section 2*b*. Namely, in the state where the spring member 5*b* contracts, the opening section 2*b* is closed by the sealing area 3*a*. This causes toner inside the toner carrying pipe 2 not to leak to the outside through the opening section 2*b*.

In a situation illustrated in FIG. 1, when an external force is applied to the end part 4*b* of the lever 4 in the direction Z, the end part 4*a* of the lever 4 pulls up the flexible sheet 3 in the direction reverse to the vertical direction. This causes (i) the flexible sheet 3 to slide, on the outer wall surface 2*d* side, in the direction reverse to the vertical direction; (ii) the flexible sheet 3 to slide, on the opening section 2*b* side, in a direction directing from the outer wall surface 2*c* to the outer wall surface 2*d*; and (iii) the flexible sheet 3 to slide, on the outer wall surface 2*c*, in the vertical direction. As a result, as illustrated in FIG. 2 and FIG. 3 (*b*), the sealing area 3*a* of the flexible sheet 3 moves so as to be on the outer wall surface 2*d* and the toner passage hole 3*b* of the flexible sheet 3 moves so as to be on the opening section 2*b*. This allows toner inside the toner carrying pipe 2 to be discharge to the outside because the opening section 2*b* of the toner carrying pipe 2 is opened to the outside.

Further, in a situation illustrated in FIG. 2, when the external force applied to the lever 4 in the direction Z is weakened, the spring member 5*b* contracts (back to the situation in FIG. 1). This causes, (i) the flexible sheet 3 to move, on the outer wall surface 2*c* side, in the direction reverse to the vertical direction; (ii) the flexible sheet 3 to move, on the opening section 2*b* side, in a direction directing from the outer wall 2*d* to the outer wall surface 2*c*; and (iii) the flexible sheet 3 to move, on the outer wall surface 2*d* side, in the vertical direction. As a result, as illustrated in FIG. 1 and FIG. 3 (*a*), the sealing area 3*a* of the flexible sheet 3 moves so as to be on the opening section 2*b*, and the toner passage hole 3*b* of the flexible sheet 3 moves so as to be on the outer wall surface 2*c*. This causes toner inside the toner carrying pipe 2 not to leak to the outside through the opening section 2*b* because the opening section 2*b* is closed by the sealing area 3*a* of the flexible sheet 3.

Namely, the toner carrying device 1 of the present embodiment includes a toner carrying pipe 2 which has an opening section (first opening section) 2*b* via which toner passes through, a flexible sheet 3 which has a toner passage hole 3*b* in its area and moves back and forth in a certain pathway, and a sheet moving mechanism (a lever 4 and a traction section 5) for pulling the flexible sheet 3 so that the flexible sheet 3 moves back and forth like above.

According to the toner carrying device 1 of the present embodiment, it is possible, by moving the flexible sheet 3 back and forth as illustrated in FIG. 3, for the sheet moving mechanism to switch between (i) a first state in which an area of the flexible sheet 3 where the toner passage hole 3*b* is not provided (sealing area 3*a*) and the opening section 2*b* overlap each other so that the opening section 2*b* is closed and (ii) a second state in which the toner passage hole 3*b* and the opening section 2*b* overlap each other so that the opening section 2*b* is opened.

Further, in the toner carrying device 1 of the present embodiment, a transformable flexible sheet 3 is used as a shutter of the opening section 2*b* of the toner carrying pipe 2. This allows a shelter of the shutter (storage space) to be freely laid out. Therefore, it is possible to downsize the toner carrying device 1 and to ultimately save a space for an image forming apparatus including the toner carrying device 1. Also, since the flexible sheet 3 is made of a flexible material, the flexible sheet 3 can be closely attached around the periphery of the opening section 2*b* in the toner carrying pipe 2, thereby preventing toner leakage from a gap.

Figure 10:
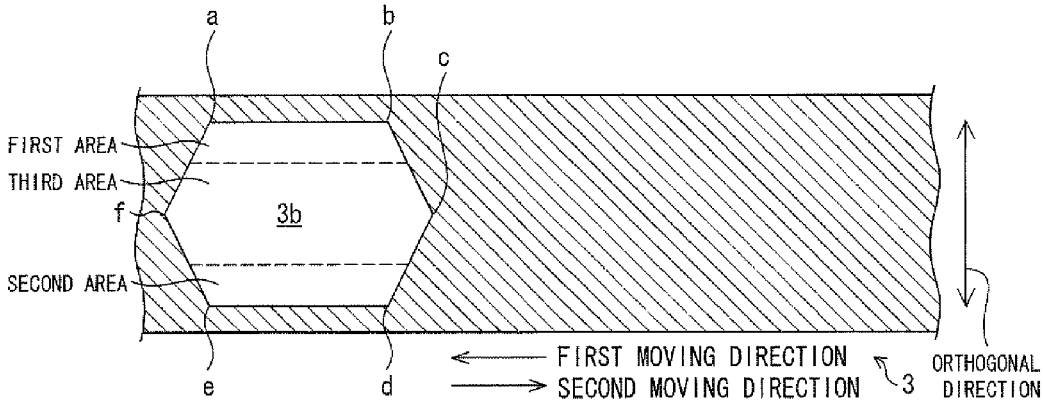
FIG. 10 (*a*) is an explanatory drawing illustrating a toner passage hole formed in the flexible sheet illustrated in FIG. 1.
Figure 10:
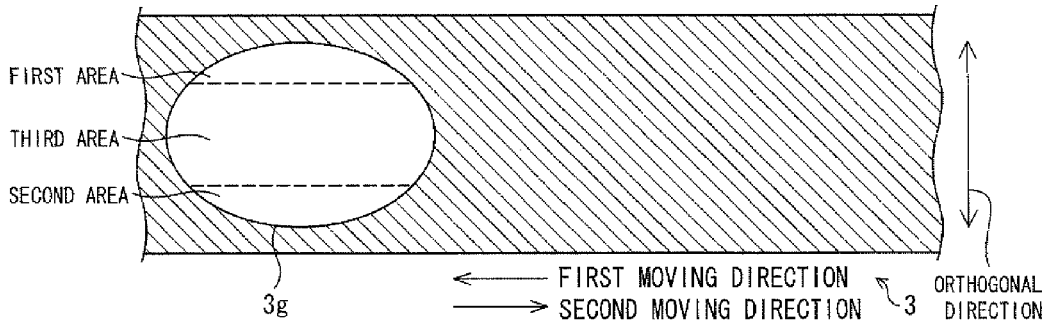
Figure 10:
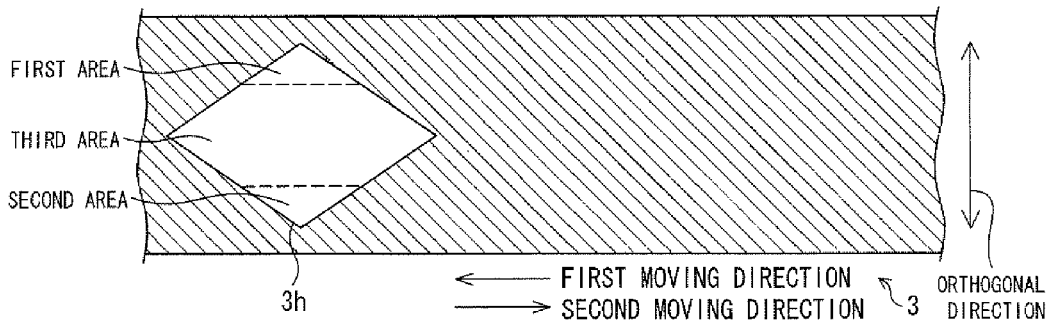
Figure 11:
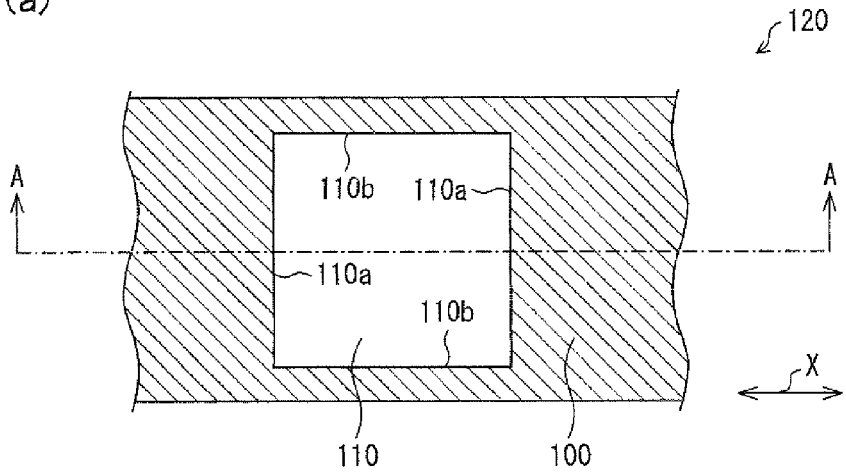
FIG. 11 (*a*) is a drawing illustrating a conventional flexible sheet.
Figure 11:
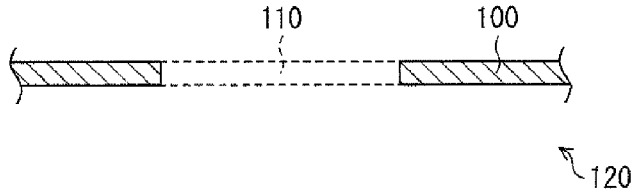
Figure 12:
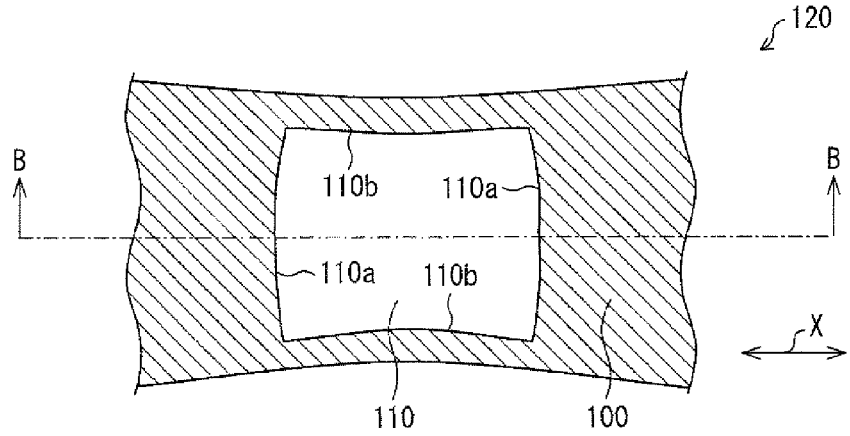
FIG. 12 (*a*) is a drawing illustrating a case where the flexible sheet in FIG. 11 was bent.
Figure 12:
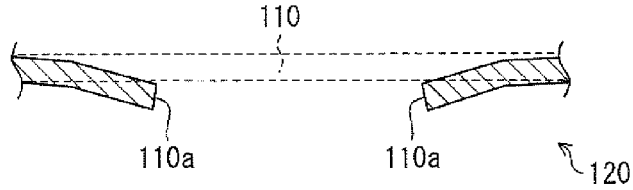

As illustrated in FIG. 10 (*a*), the toner passage hole 3*b* can be divided into three areas, i.e., first though third areas so that the three areas are arranged in a line in a direction orthogonal to the moving direction (back and forth) of the flexible sheet 3. In this case, the third area is provided so as to extend broader in the moving direction than respective of the first and second areas. Note that (i) the first area is provided on the side of one end of the flexible sheet 3 in the direction orthogonal to the moving direction; (ii) the second area is provided on the side of the other end of the flexible sheet 3 in the direction orthogonal to the moving direction; and (iii) the third area is provided between the first area and the second area. Note also that the moving direction of the flexible sheet 3 indicate a first moving direction and a second moving direction illustrated in FIG. 1 through FIG. 3 and FIG. 10.

As illustrated in FIG. 10 (*a*), the toner passage hole 3*b* is provided so that the third area extends broader in the moving direction than respective of the first and second areas. This prevents the bending from occurring around the periphery of the toner passage hole 3*b* even though the pull strength is applied to the flexible sheet 3 in the moving direction (back and forth). Therefore, it is possible to suppress the occurrence of a situation in which the periphery of the toner passage hole 3*b* gets stuck with the periphery of the opening section 2*b*, thereby resulting in smooth movement of the flexible sheet 3.

In the present embodiment, as illustrated in FIG. 10 (*a*), the toner passage hole 3*b*, having a hexagonal shape, which has a first side connecting a first vertex a and a second vertex b, a second side connecting the second vertex b and a third vertex c, a third side connecting the third vertex c and a fourth vertex d, a fourth side connecting the fourth vertex d and a fifth vertex e, a fifth side connecting the fifth vertex e and a sixth vertex f, and a sixth side connecting the sixth vertex f and the first vertex a; the first side belongs to the first area; the fourth side belongs to the second area; a diagonal line, connecting the third vertex and the sixth vertex, belongs to the third area; the first side, the fourth side, and the diagonal line are parallel to the moving direction (back and forth); and the diagonal line extends broader than respective of the first and fourth sides in the moving direction. Namely, the toner passage hole 3*b* as illustrated in FIG. 10 (*a*) is a polygon which has two obtuse angle vertices (the third vertex c and the sixth vertex f) pointing the moving direction in which the flexible sheet 3 moves back and forth (the first moving direction and the second moving direction).

Note that a shape of the toner passage hole 3*b* is not specifically limited to a hexagon illustrated in FIG. 10 (*a*). For example, as illustrated in FIG. 10 (*b*), it can be an oval toner passage hole 3*g* whose long axis is parallel to the moving direction of the flexible sheet 3 and short axis is parallel to the direction orthogonal to the moving direction. Alternatively, as illustrated in FIG. 10 (*c*), it can be a diamond passage hole 3*h* which has a diagonal line parallel to the moving direction and the other diagonal line parallel to the direction orthogonal the moving direction. What is essential is that the toner passage hole 3*b* should have a shape so that the third area extends broader in the moving direction of the flexible sheet 3 than respective of the first and second areas.

In the present embodiment, fluororesin is used as a material of the flexible sheet 3. An advantage of using fluororesin is that the flexible sheet 3 can slide smoothly because (a) fluororesin is low in frictional resistance and can reduce a frictional resistance between the flexible sheet 3 and the toner carrying pipe 2 or between the flexible sheet 3 and the pressure guide member 6, (b) toner components are less likely to be fused onto the flexible sheet 3 due to low surface energy of fluororesin.

Note that PET (polyethylene-terephthalate) can be used, instead of fluororesin, as a material of the flexible sheet 3. An advantage of using PET is that durability of the flexible sheet 3 is prolonged. Note that the most ideal flexible sheet 3 is a sheet including a base material made of PET (polyethylene terephthalate), an outer surface of the base material being subjected to application or adhesion of fluororesin. This is because such a sheet has both advantages of fluororesin (highly smooth movement of the flexible sheet 3) and PET (high durability).

Further, according to the toner carrying device 1 of the present embodiment, a guide pathway is provided for guiding the flexible sheet 3 to the first moving direction or to the second moving direction (in the direction in which the flexible sheet 3 moves back and forth). In the guide pathway, the moltopren 12 is provided in part of the wall surface (inner surface of the pressure guide member 6) via which the flexible sheet 3 is guided. This can reduce a frictional resistance exerted on the flexible sheet 3, thereby further improving the smooth movement of the flexible sheet 3.

Further, according to the toner carrying device 1 of the present embodiment, the wall surface, in the guide pathway, on which the flexible sheet 3 is guided includes the outer wall surfaces 2*c* and 2*d*. As illustrated in FIG. 1, each of the outer wall surfaces 2*c* and 2*d* has a projection section 11. This can reduce a contact area between the flexible sheet 3 and respective of the outer wall surfaces 2*c* and 2*d*, thereby reducing frictional resistances generated between the flexible sheet 3 and respective of the outer wall surfaces 2*c* and 2*d*.

Further, according to the present embodiment, as illustrated in FIG. 1, the sheet moving mechanism for moving the flexible sheet 3 back and forth includes the traction section 5 having the spring member 5*b* for pulling the flexible sheet 3 in the first moving direction, and the lever 4 for pulling the flexible sheet 3 in the second moving direction (the direction reverse to the first moving direction) when an external force is applied to the lever 4. With the arrangement, as illustrated in FIG. 1 and FIG. 2, it is possible to move the flexible sheet 3 in the second moving direction when the force to be applied to the lever 4 is increased, whereas it is possible to move the flexible sheet 3 in the first moving direction due to pull strength of the spring member 5*b* when the force to be applied to the lever 4 is decreased. Namely, with the arrangement, it is possible to move the flexible sheet 3 back and forth, by providing the simple members of the lever 4 and the spring member 5*b*. Since the arrangement does not require a complicated moving mechanism for moving the flexible sheet 3 back and forth, it is possible to downsize the toner carrying device 1.

Further, as illustrated in FIG. 1 through FIG. 3, the toner carrying device 1 of the present embodiment includes a toner carrying pipe (toner carrying member) 2 having an opening section 2*b* via which toner passes, a flexible sheet 3 which has a toner passage hole 3*b* and moves back and forth in a certain pathway, a lever (sheet moving mechanism) 4 and a traction section 5 (sheet moving mechanism) for switching, by pulling the flexible sheet so that the flexible sheet is moved back and forth, between (i) a first state in which an area of the flexible sheet where the toner passage hole is not provided and the opening section overlap each other so that the opening section is closed, and (ii) a second state in which the toner passage hole and the opening section overlap each other so that the opening section is opened. As illustrated in FIG. 3, the toner passage hole 3*b* is a hole obtained by cutting out part of the flexible sheet 3 from the flexible sheet 3 so that the edge part of the flexible sheet 3 which is around the toner passage hole 3*b* is recessed in the moving direction.

According to this structure, it is possible to suppress the occurrence of a situation in which the periphery of the toner passage hole 3*b* gets stuck with the periphery of the opening section 2*b*, thereby resulting in smooth movement of the flexible sheet 3.

As illustrated in FIG. 3, the toner passage hole 3*b* has a hexagonal shape, whose vertices are located in the edge part of the flexible sheet 3, which is around the toner passage hole 3*b* and is recessed in the moving direction.

Further, as illustrated in FIG. 1 and FIG. 2, the toner carrying device 1 includes an inner surface of the pressure guide member 6 (guide surface) on which the flexible sheet 3 is guided and moved, and the inner surface of the pressure guide member 6 includes moltopren 12 on its surface. This can reduce a frictional resistance exerted on the flexible 3, thereby further improving the smooth movement of the flexible sheet 3. Note that the outer wall surfaces 2*c* and 2*d* function as the guide surface for guiding the movement of the flexible sheet 3 and the moltopren 12 can be provided on the outer wall surfaces 2*c* and 2*d*. Further, as illustrated in FIG. 1 and FIG. 2, each of the outer wall surfaces 2*c* and 2*d* has the projection section 11. This can reduce frictional resistances generated between the flexible sheet 3 and respective of the outer wall surfaces 2*c* and 2*d*.

[Structure of an Image Forming Apparatus]

Figure 6:
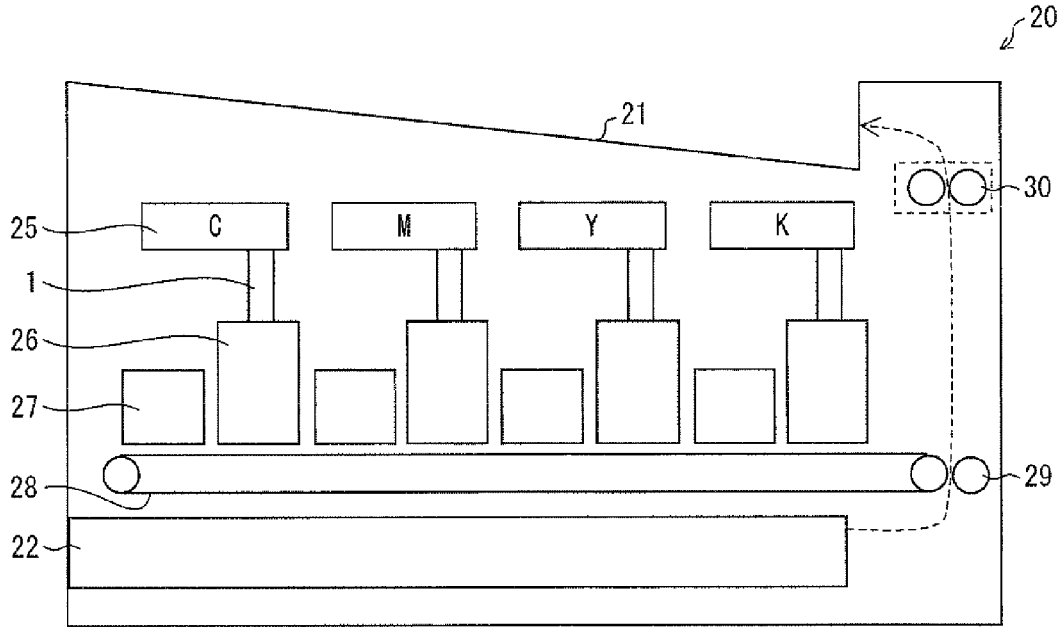
FIG. 6 is a schematic view illustrating an inner structure of an image forming apparatus of the present embodiment.
Figure 7:
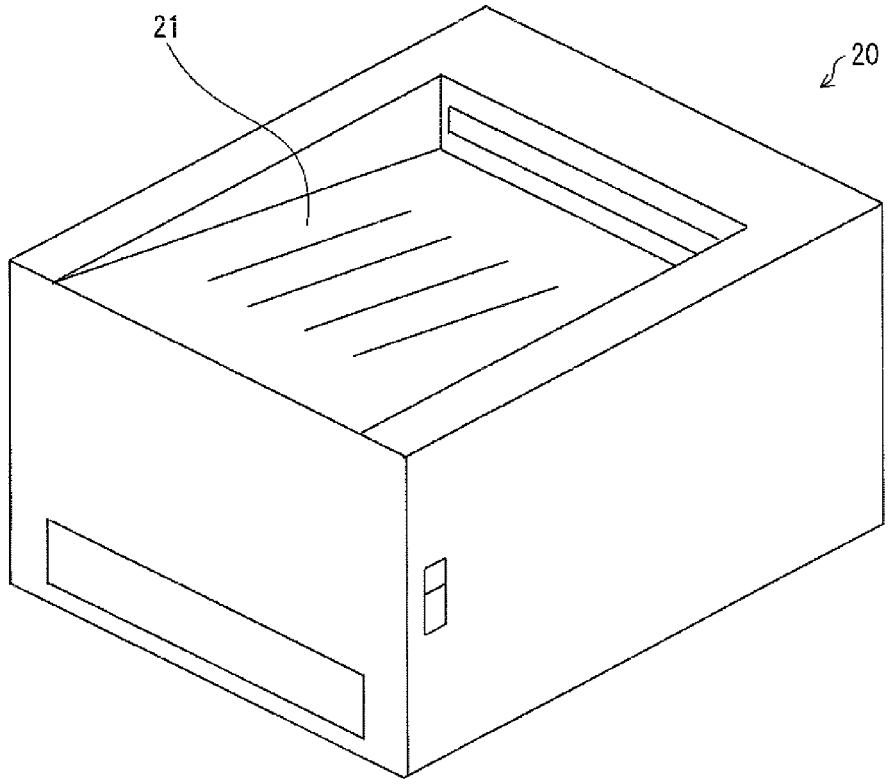
FIG. 7 is a perspective view illustrating an overview of the image forming apparatus illustrated in FIG. 6.

The following description deals with an image forming apparatus including a toner carrying device 1 illustrated in FIG. 1 through FIG. 5. FIG. 6 is a schematic view of an inner structure of an image forming apparatus 20 of the present embodiment. FIG. 7 is a perspective view of an overview of the image forming apparatus 20.

As illustrated in FIG. 7, the image forming apparatus 20 is a compactly designed printer, and a paper output tray 21 is provided in a top surface part of the apparatus. Also, as illustrated in FIG. 6, the image forming apparatus 20 is capable of forming a full color image in which four colors, cyan (C), magenta (M), yellow (Y), and black (K) are combined. The image forming apparatus 20 adopts a tandem type intermediate transfer method in which photoreceptor units for the colors CMYK are arranged in this order and developed toner images are sequentially transferred to an intermediate transfer belt.

The image forming apparatus 20 includes, for each of the colors CMYK, a toner cartridge 25 for storing toner for replenishment, a developing device (developing unit) 26 for developing an electrostatic latent image on a surface of a photoreceptor, a toner carrying device 1 for replenishing toner from the toner cartridge 25 to the developing device 26, a photosensitive unit 27 having a photoreceptor, an intermediate transfer belt 28 on which a toner image of a respective color is temporarily stacked for a following transferring process, a paper feeding cassette 22 for storing recording paper, a transfer unit 29 for transferring the toner image on the intermediate transfer belt 28 with respect to the recording paper fed by the paper feeding cassette 22, and a fixing unit 30 for fixing the toner image transferred on the recording paper.

Figure 8:
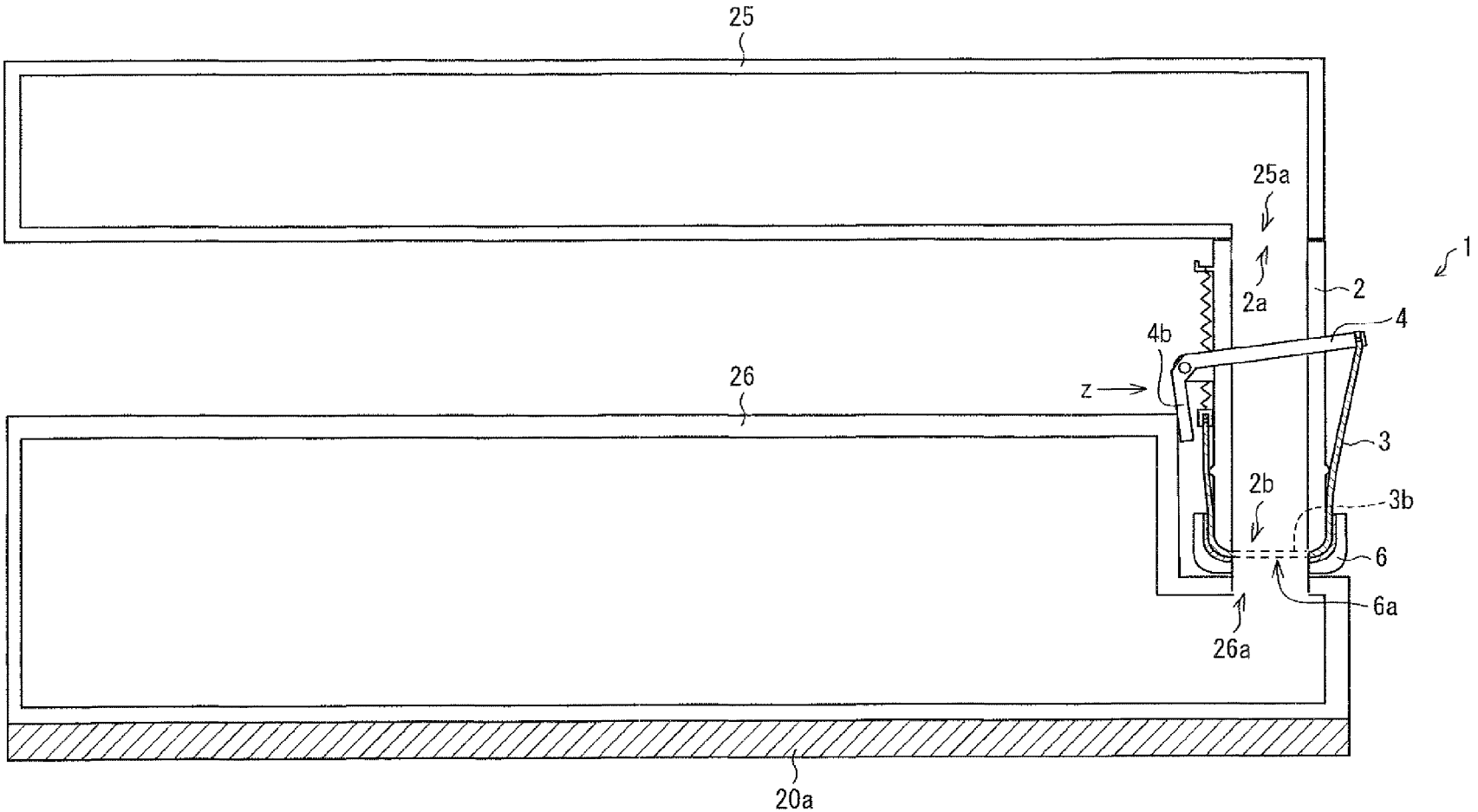
FIG. 8 is a schematic view illustrating the image forming apparatus illustrated in FIG. 6 in which a developing device is mounted.

Specifically, the toner carrying device 1 illustrated in FIG. 1 through FIG. 5 is provided between the toner cartridge 25 and the developing device 26. More specifically, as illustrated in FIG. 8, the toner cartridge 25, the toner carrying device 1, and the developing device 26 are provided in this order from top to bottom; the periphery of the opening section 6*a* of the pressure guide member 6 is connected to the periphery of a toner replenishing port 26*a* of the developing device 26; and the periphery of the opening section 2*a* of the toner carrying device 1 is connected to a periphery of a toner replenishing port 25*a* of the toner cartridge 25.

With the arrangement, an inner part of the toner cartridge 25 and an inner part of the toner carrying pipe 2 are communicated with each other via the opening section 2*a* (second opening section), which is provided in the upper end part of the toner carrying pipe 2. An inner part of the developing device 26 and the inner part of the toner carrying pipe 2 are communicated with each other via the opening section 2*b* (first opening section), which is provided in the lower end part of the toner carrying pipe 2. Therefore, toner in the toner cartridge 25 falls from the opening section 2*a* toward the inner part of the toner carrying pipe 2 and then falls from the inner part of the toner carrying pipe 2 toward the developing device 26, via the opening sections 2*b* and 6*a*.

Figure 9:
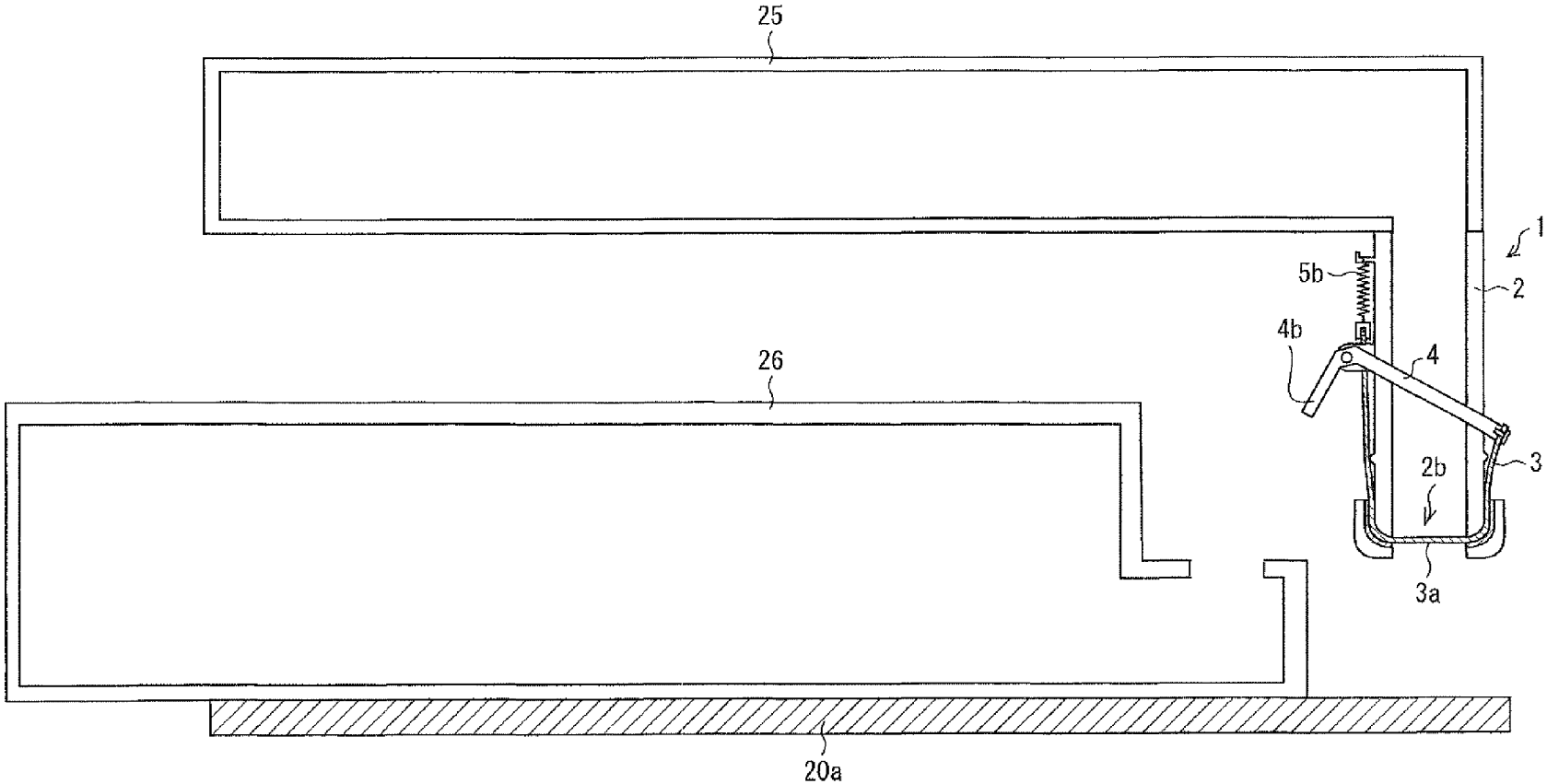
FIG. 9 is a schematic view illustrating the image forming apparatus illustrated in FIG. 6 from which the developing device is detached.

In the image forming apparatus 20, each of the developing devices 26 is a replaceable member. As illustrated in FIG. 9, the developing device 26 is detachable from the image forming apparatus 20 by sliding the developing device 26 on an upper surface of a developing device supporting table 20*a*.

In a case where the developing device 26 is detached from the image forming apparatus 20, in the toner carrying device 1, an end part 4*b* of a lever 4 is free from an external force, and so a spring member 5*b* is in a situation of contraction as illustrated in FIG. 9. Therefore, the opening section 2*b* of the toner carrying pipe 2 is closed and toner in the toner cartridge 25 never comes out from the opening section 2*b* of the toner carrying pipe 2.

On the other hand, in a case where the developing device 26 is mounted to the image forming apparatus 20, an outer wall surface of the developing device 26 contacts the end part 4*b* of the lever 4, thereby resulting in that an external force is applied to the end part 4*b* in a direction Z as illustrated in FIG. 8. This causes the opening section 2*b* of the toner carrying pipe 2 to open, thereby resulting in that toner in the toner cartridge 25 goes down toward the developing device 26 via the toner carrying pipe 2, in a case where the developing device 26 is mounted to the image forming apparatus 20.

Although FIG. 8 and FIG. 9 do not illustrate, the image forming apparatus 20 includes a shutter for opening or closing the toner replenishing port 25*a* of the toner cartridge 25. When the toner cartridge 25 or the developing device 26 is detached from the image forming apparatus 20, the shutter closes the toner replenishing port 25*a* of the toner cartridge 25. When the toner cartridge 25 or the developing device 26 is mounted to the image forming apparatus 20, the shutter moves and opens the toner replenishing port 25*a*.

The above described toner carrying device includes a toner carrying pipe which includes a first opening section via which toner passes; a flexible sheet which includes a toner passage hole in part of its area and moves back and forth in a certain pathway; and a sheet moving mechanism for switching, by pulling the flexible sheet so that the flexible sheet is moved back and forth, between (i) a first state in which an area of the flexible sheet where the toner passage hole is not provided and the first opening section overlap each other so that the first opening section is closed and (ii) a second state in which the toner passage hole and the first opening section overlap each other so that the first opening section is opened, the toner passage hole being divided (i) so as to be divided into first through third areas are arranged in a line in a direction orthogonal to a moving direction in which the flexible sheet is moved back and forth, and (ii) so that the third area extends broader in the moving direction than respective of the first and second areas, where the first area is provided on a side of one end of the flexible sheet in the direction orthogonal to the moving direction, the second area is provided on a side of the other end of the flexible sheet in the direction orthogonal to the moving direction, and the third area is provided between the first area and the second area.

Same as this toner carrying device, in a case where the third area extends broader in the moving direction than respective of the first and second areas, it is possible to prevent bending from occurring around the periphery of the toner passage hole even though a pull strength is applied to the flexible sheet so as to move it back and forth in the moving direction. Therefore, it is possible to suppress the occurrence of a situation in which the periphery of the toner passage hole gets stuck with the periphery of the first opening section, thereby resulting in smooth movement of the flexible sheet.

Further, in the toner carrying device, the toner passage hole may have a hexagonal shape, which has a first side connecting a first vertex and a second vertex, a second side connecting the second vertex and a third vertex, a third side connecting the third vertex and a fourth vertex, a fourth side connecting the fourth vertex and a fifth vertex, a fifth side connecting the fifth vertex and a sixth vertex, and a sixth side connecting the sixth vertex and the first vertex; the first side may belong to the first area; the fourth side may belong to the second area; a diagonal line, connecting the third vertex and the sixth vertex, may belong to the third area; the first side, the fourth side, and the diagonal line may be parallel to the moving direction; and the diagonal line may extend broader than respective of the first and fourth side in the moving direction. In a case where the toner passage hole has a hexagonal shape as above described, it is possible to form such a shape of the toner passage hole that the third area extends broader in the moving direction than respective of the first and second areas.

Further, in the toner carrying device, it is preferable that the flexible sheet is made of fluororesin. This can reduce a frictional resistance exerts on the flexible sheet in a sliding movement, thereby further improving the smooth movement of the flexible sheet. Further, since toner is less likely to be fused on to fluororesin, it is possible to prevent a problem of increasing in frictional resistance caused by a part of a surface of the sliding sheet on which toner is fused.

Further, in the toner carrying device, it is preferable that the flexible sheet is made of polyethylene terephthalate. This can increase durability of the flexible sheet because polyethylene terephthalate is a resin which is excellent in strength.

Further, in the toner carrying device, it is preferable that the sliding sheet includes a base material made of polyethylene terephthalate, an outer surface of the base material being subjected to adhesion of fluororesin. With this structure, it is possible to possess both advantages of fluororesin (smooth movement of the flexible sheet) and polyethylene terephthalate (improvement in durability of the flexible sheet).

Further, it is preferable that the toner carrying device includes a guide pathway, via which the flexible sheet is guided in the moving direction and moltopren is provided on a wall surface of the guide pathway, via which wall surface the flexible sheet is guided. This structure allows the flexible sheet to move more smoothly because moltopren is low in friction resistance and is capable of reducing a friction resistance exerting on the flexible sheet even though the flexible sheet contacts the wall surface in the guide pathway.

Further, in the toner carrying device, it is preferable that a guide pathway, via which the flexible sheet is guided in the moving direction, is provided; and a wall surface of the guide pathway, via which wall surface the flexible sheet is guided, includes outer wall surfaces of the toner carrying pipe, each of the outer wall surfaces including a projection on its surface. According to this structure, the projection can reduce a touch area between the flexible sheet and the outer wall. This can reduce a friction resistance generated between the flexible sheet and the wall surface in the guide pathway, thereby further improving the smooth movement of the flexible sheet.

Further, in the toner carrying device, it is preferable that the moving direction includes a first moving direction and a second moving direction reverse to the first moving direction; and the sheet moving mechanism includes (i) an elastic member for pulling the flexible sheet in the first moving direction and (ii) a lever member for pulling the flexible sheet toward the second moving direction when an external force is applied. With this structure, it is possible to move the flexible sheet in the second moving direction when the force to be applied to the lever member is increased, whereas it is possible to move the flexible sheet in the first moving direction due to pull strength of the elastic member when the force to be applied to the lever is decreased. Namely, with this arrangement, even such simple members, the lever member and the elastic member, can move the flexible sheet back and forth. As a result, it is not necessary to include a complicated movement mechanism for moving the flexible sheet back and forth, thereby leading to a downsizing of the toner carrying device.

Further, the above described image forming apparatus includes the toner carrying device, a developing device, and a toner cartridge; the toner cartridge, the toner carrying device, and the developing device being provided in this order from top to bottom; the first opening section being provided in a lower end of the toner carrying pipe and the second opening section being provided in an upper end part of the toner carrying pipe; an inner part of the toner cartridge and an inner part of the toner carrying pipe being communicated with each other via the second opening section, and an inner part of the developing device and the inner part of the toner carrying pipe being communicated with each other via the first opening section. According to the image forming apparatus, it is possible to carry toner inside the toner cartridge to the inner part of the developing device via the toner carrying pipe because the inner part of the toner cartridge and the inner part of the developing device are communicated with each other via the toner carrying pipe.

The present technology is not limited to the description of the embodiments above, but may be altered by a skilled person within the scope of the claims. An embodiment based on a proper combination of technical means disclosed in different embodiments is encompassed in the technical scope of the present technology.

The embodiments and concrete examples of implementation discussed in the foregoing detailed explanation serve solely to illustrate the technical details of the present technology, which should not be narrowly interpreted within the limits of such embodiments and concrete examples, but rather may be applied in many variations within the spirit of the present technology, provided such variations do not exceed the scope of the patent claims set forth below.

What is claimed is:

1. A toner carrying device comprising:

a toner carrying pipe which includes a first opening section via which toner passes;

a flexible sheet which includes a toner passage hole in part of its area and which moves back and forth in first and second moving directions along a certain pathway; and a sheet moving mechanism for switching, by pulling the flexible sheet so that the flexible sheet is moved back and forth in the first and second moving directions, between (i) a first state in which an area of the flexible sheet where the toner passage hole is not provided and the first opening section overlap each other so that the first opening section is closed and (ii) a second state in which the toner passage hole and the first opening section overlap each other so that the first opening section is opened, wherein the sheet moving mechanism comprises an elastic member that urges the flexible sheet to move in one of the first and second moving directions, wherein a guide pathway, via which the flexible sheet is guided in the first and second moving directions, is provided, and wherein a flexible cushioning material is provided on a wall surface of the guide pathway, via which wall surface the flexible sheet is guided.

2. The toner carrying device as set forth in claim 1, wherein the flexible sheet is made of fluororesin.

3. The toner carrying device as set forth in claim 1, wherein the flexible sheet is made of polyethylene terephthalate.

4. The toner carrying device as set forth in claim 1, wherein the flexible sheet is a sheet including a base material made of polyethylene terephthalate, an outer surface of the base material being subjected to adhesion of fluororesin.

5. The toner carrying device as set forth in claim 1, wherein a wall surface of the guide pathway, via which wall surface the flexible sheet is guided, includes outer wall surfaces of the toner carrying pipe, each of the outer wall surfaces including a projection on its surface.

6. The toner carrying device as set forth in claim 1, wherein the sheet moving mechanism includes a lever member for pulling the flexible sheet in the other of the first and second moving direction when an external force is applied.

7. The toner carrying device as set forth in claim 1, wherein the toner passage hole is provided (i) so as to be divided into first through third areas so that the first through third areas are arranged in a line in a direction orthogonal to the first and second moving directions in which the flexible sheet is moved back and forth, and (ii) so that the third area extends broader in the first and second moving directions than the first and second areas, where the first area is provided on a side of one end of the flexible sheet in the direction orthogonal to the first and second moving directions, the second area is provided on a side of the other end of the flexible sheet in the direction orthogonal to the first and second moving directions, and the third area is provided between the first area and the second area.

8. The toner carrying device as set forth in claim 7, wherein:

the toner passage hole has a hexagonal shape, which has a first side connecting a first vertex and a second vertex, a second side connecting the second vertex and a third vertex, a third side connecting the third vertex and a fourth vertex, a forth side connecting the fourth vertex and a fifth vertex, a fifth side connecting the fifth vertex and a sixth vertex, and a sixth side connecting the sixth vertex and the first vertex;

the first side belongs to the first area;

the fourth side belongs to the second area;

a diagonal line, connecting the third vertex and the sixth vertex, belongs to the third area;

the first side, the fourth side, and the diagonal line are parallel to the first and second moving directions; and the diagonal line extends broader than the first and fourth sides in the first and second moving directions.

9. The toner carrying device as set forth in claim 1, wherein the flexible cushioning material comprises a flexible polyurethane foam.

10. An electrophotographic image forming apparatus comprising:

a developing device;

a toner cartridge; and a toner carrying device comprising:

a toner carrying pipe which includes a first opening section and a second opening section via which toner passes;

a flexible sheet which includes a toner passage hole in part of its area and which moves back and forth in a certain pathway; and a sheet moving mechanism for switching, by pulling the flexible sheet so that the flexible sheet is moved back and forth, between (i) a first state in which an area of the flexible sheet where the toner passage hole is not provided and the first opening section overlap each other so that the first opening section is closed and (ii) a second state in which the toner passage hole and the first opening section overlap each other so that the first opening section is opened; and a guide pathway, via which the flexible sheet is guided, wherein a flexible cushioning material is provided on a wall surface of the guide pathway, via which wall surface the flexible sheet is guided, the toner cartridge, the toner carrying device, and the developing device being provided in this order from top to bottom;

the first opening section being provided in a lower end part of the toner carrying pipe, and the second opening section being provided in an upper end part of the toner carrying pipe; and an inner part of the toner cartridge and an inner part of the toner carrying pipe communicating with each other via the second opening section, and an inner part of the developing device and the inner part of the toner carrying pipe communicating with each other via the first opening section.

11. The electrophotographic image forming apparatus as set forth in claim 10, wherein the flexible cushioning material comprises a flexible polyurethane foam.

12. A toner carrying device comprising:

a toner carrying member which includes a first opening section via which toner passes;

a flexible sheet which includes a toner passage hole and which moves back and forth in a certain pathway; and a sheet moving mechanism for switching, by pulling the flexible sheet so that the flexible sheet is moved back and forth in first and second moving directions, between (i) a first state in which an area of the flexible sheet where the toner passage hole is not provided and the first opening section overlap each other so that the first opening section is closed and (ii) a second state in which the toner passage hole and the first opening section overlap each other so that the first opening section is opened;

a first guide surface on which the flexible sheet is guided and moved;

the first guide surface including a projection on its surface, the toner passage hole being a hole obtained by cutting out part of the flexible sheet from the flexible sheet, and an edge part of the flexible sheet which is around the toner passage hole being recessed in the first and second moving directions.

13. The toner carrying device as set forth in claim 12, wherein the toner passage hole has a hexagonal shape, whose vertices are located in the edge part which is recessed in the first and second moving directions.

14. The toner carrying device as set forth in claim 12, wherein the flexible sheet is made of fluororesin.

15. The toner carrying device as set forth in claim 12, wherein the flexible sheet is made of polyethylene terephthalate.

16. The toner carrying device as set forth in claim 12, wherein the flexible sheet is a sheet including a base material made of polyethylene terephthalate, an outer surface of the base material being subject to adhesion of fluororesin.

17. The toner carrying device as set forth in claim 12, further comprising a second guide surface on which the flexible sheet is guided and moved, the second guide surface including a flexible cushioning material on its surface.

18. The toner carrying device as set forth in claim 17, wherein the flexible cushioning material comprises a flexible polyurethane foam.

19. The toner carrying device as set forth in claim 12, wherein the sheet moving mechanism includes (i) an elastic member for pulling the flexible sheet in the first moving direction and (ii) a lever member for pulling the flexible sheet in the second moving direction when an external force is applied.

* * * * *